US005718090A

United States Patent [19]

Wei-Hwang

[11] Patent Number: 5,718,090

[45] Date of Patent: Feb. 17, 1998

[54] PRESTRESSED CONCRETE TENSIONING SYSTEM

[76] Inventor: Lin Wei-Hwang, 7F-2, No. 95-8 Chang Ping Rd. Sec. 1, Taichung, Taiwan

[21] Appl. No.: 669,051

[22] Filed: Jun. 24, 1996

[51] Int. Cl.[6] ..... E04C 3/26; E04C 5/08; E04B 1/38

[52] U.S. Cl. ..... 52/223.14; 264/228; 264/229; 264/136 R; 264/122.6

[58] Field of Search ..... 52/223.1, 223.13, 52/223.14; 24/122.6, 136 R; 264/228, 229

[56] References Cited

U.S. PATENT DOCUMENTS

| | | | |
|---|---|---|---|
| 4,362,421 | 12/1982 | Kelly | 264/228 X |
| 4,507,008 | 3/1985 | Adl et al. | 24/122.6 X |
| 4,641,816 | 2/1987 | Kishida et al. | 24/136 R X |
| 4,744,691 | 5/1988 | Thal | 24/136 R X |
| 4,888,922 | 12/1989 | Lancelot | 52/223.1 X |
| 4,936,006 | 6/1990 | Creedon | 264/228 X |
| 5,022,780 | 6/1991 | Shaw | 24/122.6 X |
| 5,136,755 | 8/1992 | Shaw | 24/122.6 |
| 5,342,568 | 8/1994 | Yokota | 264/228 |
| 5,369,849 | 12/1994 | De France | 24/136 R |

*Primary Examiner*—Carl D. Friedman
*Assistant Examiner*—Yvonne Horton-Richardson

[57] ABSTRACT

A prestressed concrete tensioning system for a tensioning tendon in the construction of a prestressed concrete beam comprising an anchor seat and a prestressed tensioning device. The anchor seat embedded in one end of the beam and has spherical structure and inverse ratchet gripping device therein for adjustably holding one end of the tendon. The tensioning device has a hollow cylindrical housing including a hydraulic fluid chamber therein for slidably disposing a piston member in associated with a wedged surface grip means which are operated by hydraulic pressure for gripping and tensioning one end of the tendon, and a hemisphere concave in the forward end of the housing for engaging with the hemisphere convex of the anchor seat to obtain an universal joint effect. This disclosure is characterized in the prevention of shear and strength declination to the tendon and the risk to the ambient personnel. A supplemental tensioning device is provided to give greater flexibility to the prestressed concrete tensioning operation.

4 Claims, 5 Drawing Sheets

PRESTRESSED CONCRETE TENSIONING SYSTEM

BACKGROUND OF THE INVENTION

The present invention relates to prestressed concrete construction engineering, and more particularly to a prestressed concrete tensioning system which can prevent the tendon from creating shear and/or declination of strength and which provides great protection to the operators.

Prestressed structure is broadly adapted to the reinforced concrete beam construction because it provide pre-strutting to the beam for balancing the external loads. In construction of a bridge, it is known that the more the piers, the less the panels. However, it is difficult to construct the piers in a river. Because, an cofferdam has to be prepared to divert the water therefrom prior to the construction of a pier. This wastes a lot of time and labor. Currently, the bridge construction tends reduce the number of piers and the prestressed concrete beam is therefore adaptable for its high strength, low dead load and longer span. Conventional prestressed concrete beam is constructed including a number of tendons which are anchored at two ends of the beam and provide tension force to the tendon, in addition to an anchor which grips the steel cable, After the removal of an external hydraulic pressure system, the tendons will provide axial pressure to the beam. Because of the arcuate arrangement of the steel cables, an up-arched pro-supporting force will be created against the external load.

Prior art tensioning system (as shown in FIG. 1) comprises a cylindrical housing 1 utilizing a hydraulic pressure device to actuate a piston member 2 moving rightward so that the camming surface 3 of the piston member 2 forces the wedged surface grip jaws 4 moving inward to strenuously hold one end of a steel cable (tendon) 5, the other end of the steel cable (tendon) 5 is held by an anchor. When the tensioning system wholly moves rightward to tense up the cable (tendon) 5 that provides pro-chamber upward for supporting to the bridge and that the cable (tendon) 5 directly burden with the load from the surface of the bridge. However, if the cable (tendon) 5 is suddenly broken for over tensioning, it will burst out to hurt the people who are working there ahead. Secondly, it is uncertain that is there a co-linear existed between the tensioning direction of the cable (tendon) 5 and the gripping direction of the anchor. If the tensioning direction of the cable (tendon) 5 has found a slight deviation, it is unadjustable by the anchor. So that the prestressed strength of the cable (tendon) 5 will he declined because of the shear created within the anchor and that the concentration of stress from hereto brings forth a damage. Besides, prior art tensioning system adapts only a single hydraulic pressure device. There is no any additional hydraulic device provided to work in concert with if an extraordinary tensioning force is required, therefore its capability is limitative.

SUMMARY OF THE PRESENT INVENTION

The present invention has a main object to provide a prestressed concrete tensioning system which has a spherical joint adjustable in a prestressed anchor seat to prevent the seat from creation of shear therein for obviating a strength declination of the tendons.

Another object of the present invention is to provide a prestressed concrete tensioning system which provides greater protection to the operators when the tendon is broken.

Still another object of the present invention is to provide a prestressed concrete tensioning system in which the tensioning force is adjustable according to engineering requirements.

To fullfill the above objects and features, the prestressed concrete tensioning system of the present invention comprises general a prestressed anchor seat having a specifically designed spherical joint which is adjustably disposed in the anchor seat for gripping one end of the tendon, and a prestressed tensioning device having a hydraulic piston member in corporation with specifically designed grip jaws slidably disposed therein for effectively gripping the other end of the tendon. An additional hydraulic device engageable with the existing hydraulic system is provided to supply extraordinary hydraulic force in order to cope with the situation when a stronger tensioning force is required.

The present invention will become more fully understood by reference to the following detailed description thereof when read in conjunction with the attached drawings.

DETAILED DESCRIPTION OF THE PREFERRED EMBODIMENT

Figure 1:
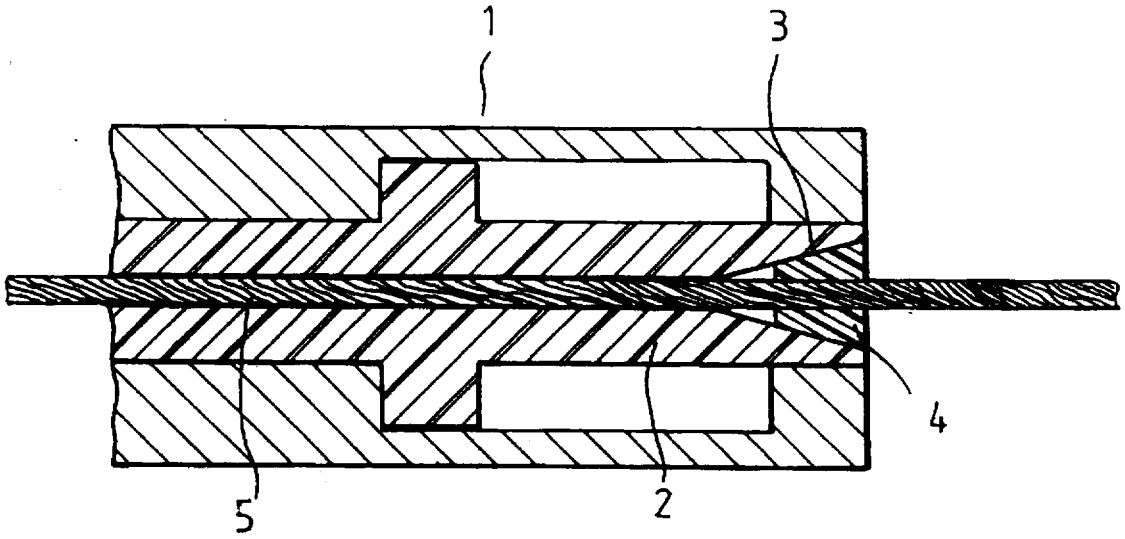
FIG. 1 PRIOR ART
FIG. 1 is a sectional view to show a prestressed concrete tensioning system of a prior art.
Figure 2:
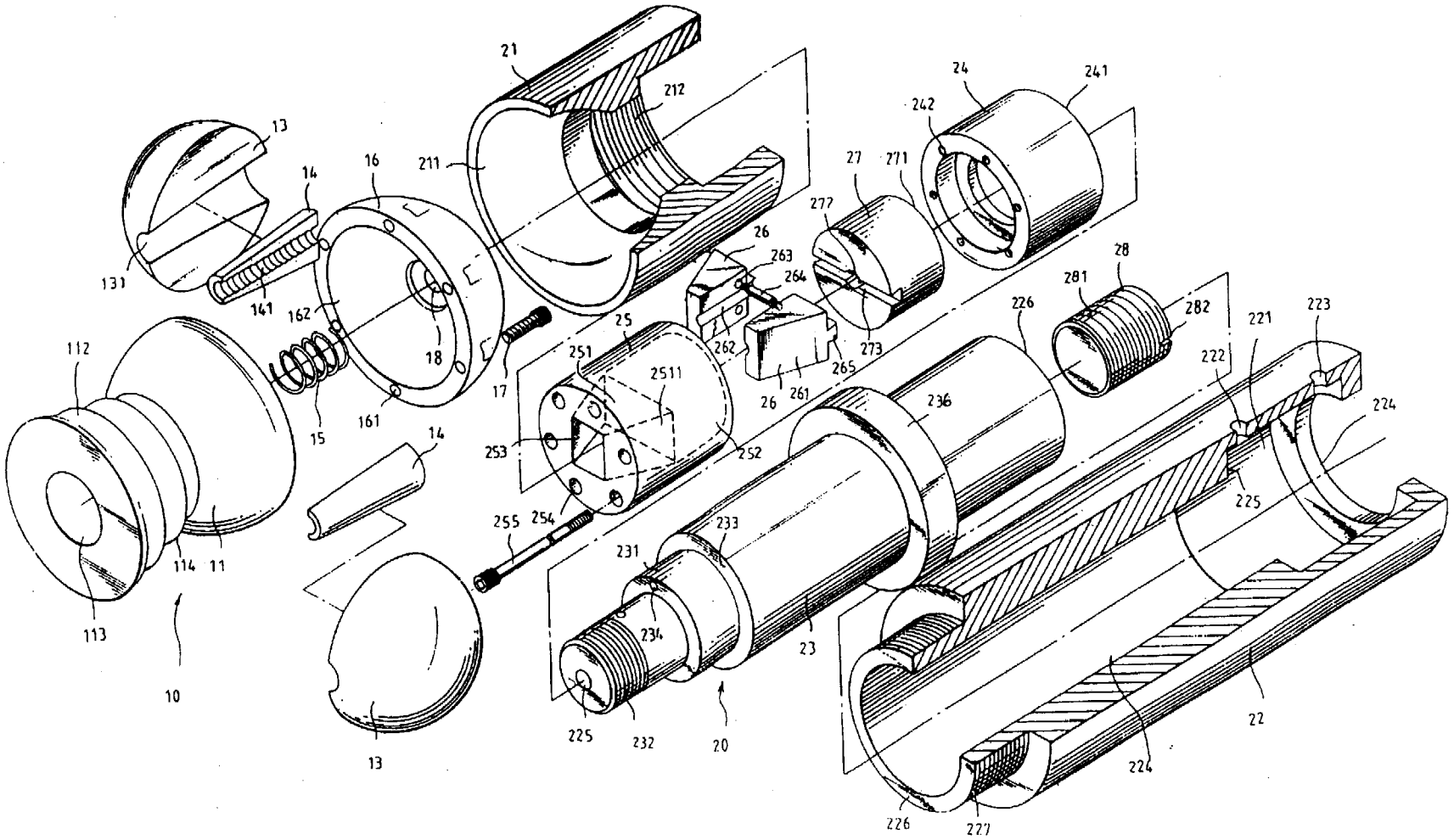
FIG. 2 is an exploded perspective view to show a preferred embodiment of the prestressed concrete tensioning system according to the present invention.
Figure 3:
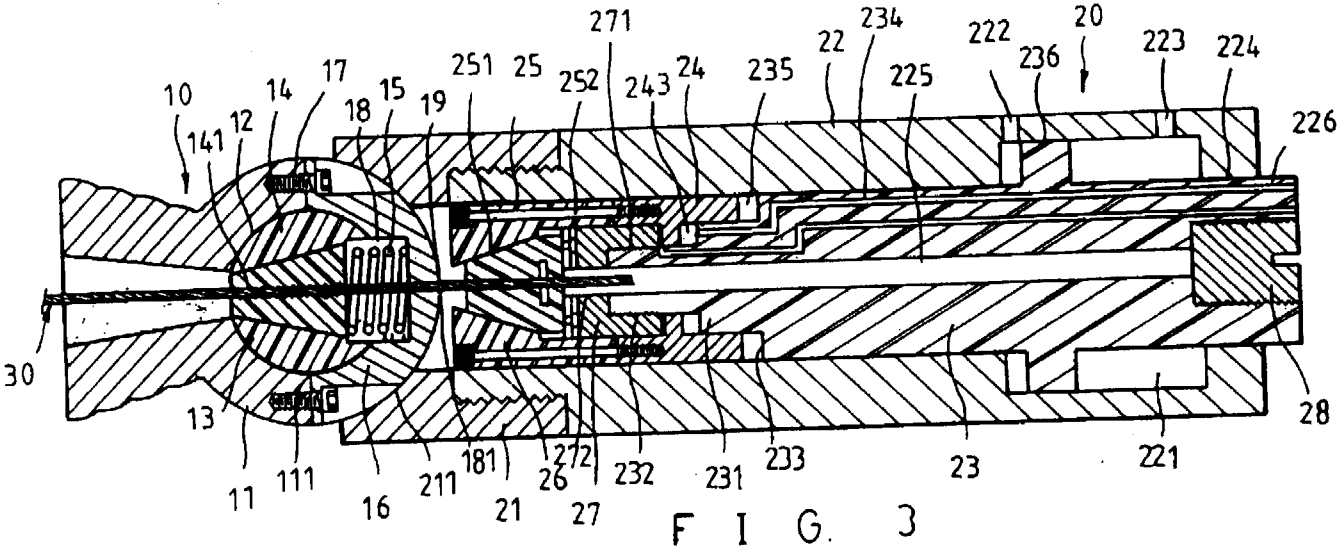
FIG. 3 is a sectional view to show an assembled prestressed concrete tensioning system of the present invention.

With reference to FIGS. 2 and 3 of the drawings, the prestressed concrete tensioning system of the present invention comprises generally a prestressed anchor seat 10 and a prestressed tensioning system 20, wherein, the anchor seat 10 is comprised of a hollow hemisphere body 11 having a plurality of screw holes 111 formed spaced apart around the rim, a tapered extension 112 including a tapered central bore 113 therein centrally projected from the bottom thereof, the extension 112 has a corrugated outer periphery 114 which facilitates a better engagement when the anchor seat 10 is embedded in the end portion of a concrete beam, a hollow hemisphere cover 16 closed the body 11 and connected by means of a plurality of screws 17 so as to define a spherical receiving space 162 thereinbetween for receiving a sphere member 13. The hemisphere cover 16 has a plurality of screw holes 161 formed spaced apart around the rim made in registry with the screw holes 111, a central recess 18 formed in the bottom thereof for receiving a compressed spring 15 therein and an aperture 181 through the bottom center of the recess 18. The sphere member 13 has a tapered central bore 131 and a dimension equal to the spherical receiving space 162 and a tapered gripping means 14 disposed into the tapered central bore 131 thereof and having inverse ratchets 141 through the center for preventing the steel tendon 30 from sliding backward. Both the sphere member 13 and the tapered gripping means 14 are equally divided into two corresponding parts along their axial lines. When the sphere member 13 disposes into the spherical receiving space 162, the tapered central bore 131 should be in alignment with the aperture 181 and the bore 113.

The prestressed tensioning device 20 comprises an adaptor 21, a hollow cylinder housing 22, a piston member 23, an annular ring 24, a grip housing 25, a pair of grip jaws 26, a grip assembly 27 and a safety stopper 28.

The adaptor 21 has a hollow cylinder body diametrically equal to the housing 22, a hemispherical concave 211 centrally formed in the fore end for engaging the hemisphere cover 16 of the anchor seat 10 and a threaded inner periphery 212 in the inward end thereof.

The hollow cylinder housing 22 has a hydraulic chamber 221 in a rear portion communicated to an external hydraulic source via a pair of hydraulic conduits 222 and 223 through a peripheral wall thereof, a central bore 224 abutting the chamber 221 and defining a shoulder 225 therebetween, a neck 226 axially extended outward from the fore end and having threaded outer periphery 227 for engaging with the threaded inner periphery 212 of the adaptor 21.

The piston member 23 comprises a cylindrical body which has a diameter equal to the inner diameter of the central bore 224 so as to slidably dispose into the cylinder housing 22, a stepped extension 231 axially extended from the fore end having a threaded outer periphery 232, a central bore 225 axially extended through the body, an annular flange 236 projected outward from a peripheral wall at an appropriate position and a peripherally threaded recess 226 formed in the rear end thereof for engaging the safety stopper 28 which has a threaded outer periphery 281 made in registry with the threaded recess 226 and a transverse slot 282 in the outward end thereof. The piston member 22 further has an oil conduit 234 formed through the body for connecting to an additional hydraulic device (not shown).

The annular ring 24 slidably engages the neck 231 of the piston member 23 for defining a pair of annular chambers 235 and 243 therebetween and has a flange 241 extended inward from a medial inner periphery and a plurality of screw holes 242 formed spaced apart around the front rim thereof.

The grip housing 25 has a hollow cylindrical body, a tapered groove 251 communicating with a cylindrical space 252 and a rectangular opening 253 through the center of the fore end for receiving the grip jaws 26 and the grip assembly 27 therein and a plurality of screw holes 254 made in registry with the screw holes 242 for engaging the grip housing 25 with the annular ring 24 by means of screws 255.

The pair of grip jaws 26 each has a wedged surface 261, a semi-circular slot 262 axially formed in a flat portion, a pair of axle holes 263 adjacent the slot 262 for engaging in a pair of spring rods 264 therebetween and a dovetail tang 265 transversely extended on the bottom thereof.

The grip assembly 27 has a hollow cylindrical body of U-shaped section including a threaded inner periphery 271 made in registry with the threaded outer periphery 232 so as to engage the grip assembly 27 with the stepped extension 231 of the piston member 23 which is firstly inserted through the flange 241 of the annular ring 24, a central bore 272 axially extended through the body and a dovetail groove 273 radially extended in the fore end thereof.

FIG. 3 shows an assembled tensioning system of the present invention. In operation, secure one end of a steel tendon 30 at a first end of a concrete beam, then insert the other end of the tendon 30 through the central bore 113, the tapered gripping means 14, the spring 15 and the aperture 181 of the anchor seat 10 which is precedingly embedded in and solidified at the second end of the concrete beam, and then insert the tendon 30 through the slot 262 of the grip jaws 26 and the central bore 272 of the grip assembly 27 and terminated at an appropriate position inside the central bore 225 of the piston member 23. Meanwhile, the hemispherical surface of the anchor seat 10 engages the hemispherical concave 211 of the adaptor 21.

Figure 4:
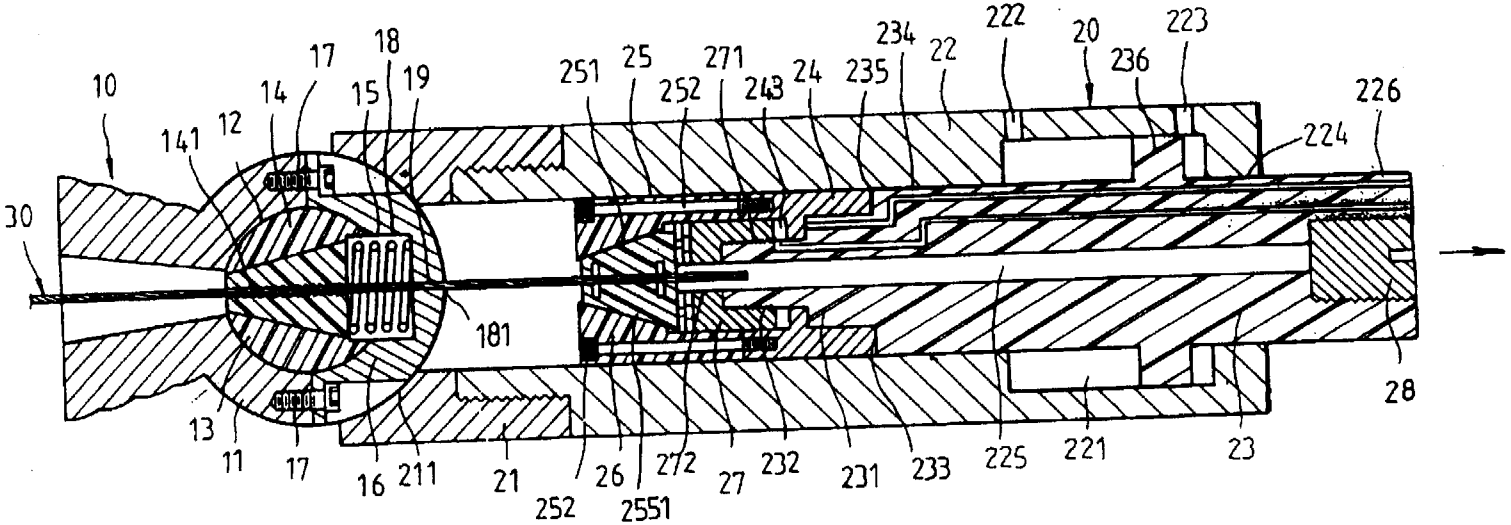
FIG. 4 is a sectional view to show an operational state of FIG. 3.

When the hydraulic pressure in the chamber 235 is released via the conduit 234, the annular ring 24 in associating with the grip housing 25 will move rightward closer to the piston member 23 that the camming surfaces 2511 of the grip housing 25 press the wedge surfaces 261 of the grip jaws 26 so as to force the grip jaws 26 moving inward toward each other to tightly grip the other end of the tendon 30. Additionally, supply the hydraulic, fluid via the conduit 222 into the chamber 221 that the annular flange 236 of the piston member 23 is forced to move toward rightward (as shown in FIG. 4). Because of that the annular ring 24 associating with the grip housing 25 attaches to the piston member 23, it will move in concert with the piston member 23 to tense the tendon 30 rightward. Meanwhile, the tapered gripping means 14 in the sphere member 13 of the anchor seat 10 will prevent the tendon 30 from sliding backward because of the inverse ratchets 141 which only permit the tendon 30 to move rightward. If the tensioning force exerted on the tendon 30 exceeds a limit to cause a breakage of the tendon 30, the broken end will burst out but is prevented by the stopper 28 to obviate the ambient personnel to get hurt. Besides, both the cover 16 of the anchor seat 10 and the adaptor 21 of the tensioning device 20 have their convex and concave spherical surfaces which can automatically admit the tensioning axis into a co-linear and obviate shear to be created at any gripping point on the tendon 30 therefore, without causing a stress concentration or an accidental breakage in normal condition.

After the completion of the tensioning process, the tendon 30 is cut off and reserves an appropriate length which is bent over and inserted into the aperture 181 of the cover 16. This arrangement facilitates a compensatory tensioning process that may be required at later stage.

Figure 5:
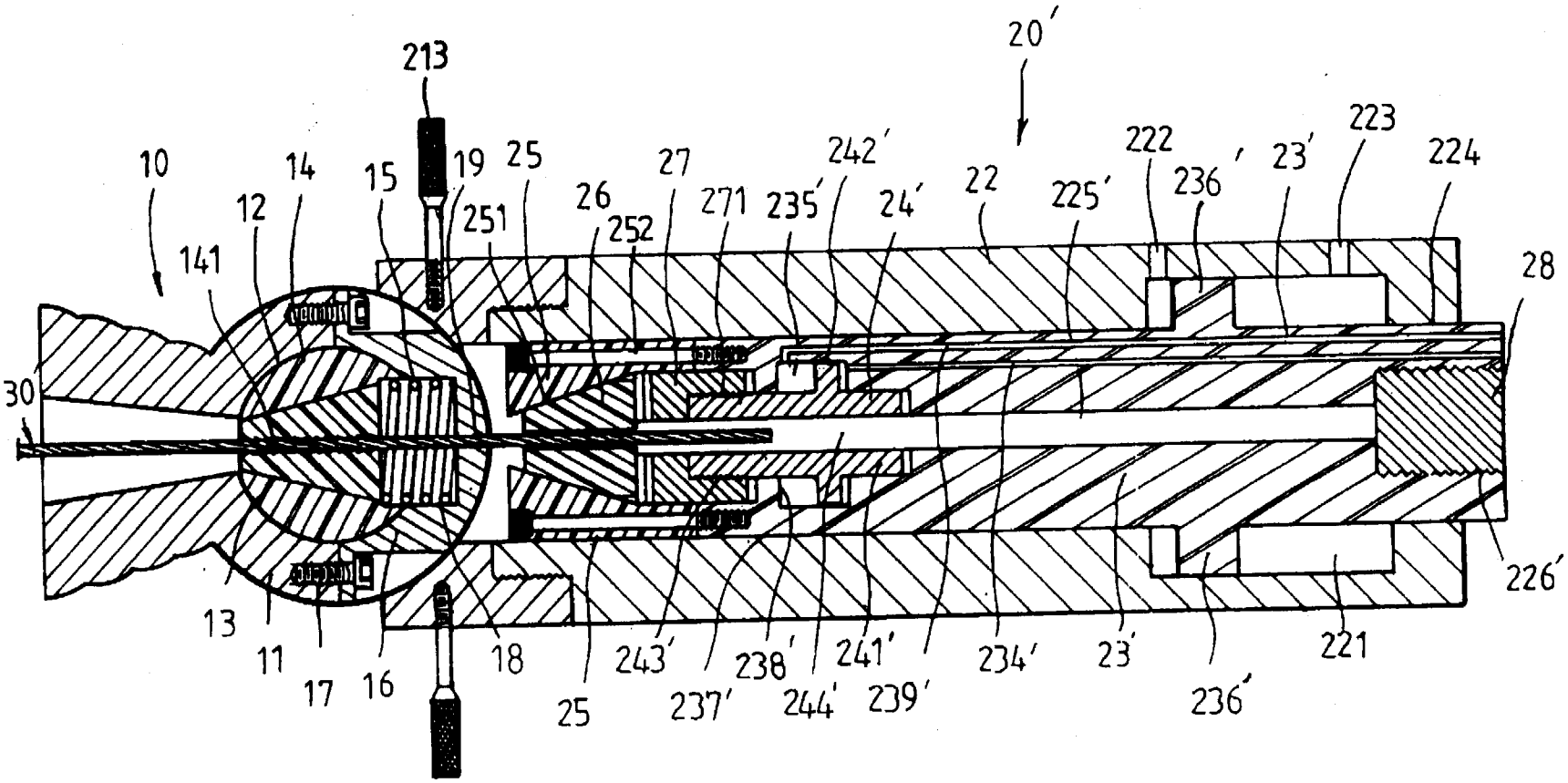
FIG. 5 is a sectional view to show an alternative embodiment of the present invention.

Referring to FIG. 5, an alternative embodiment of the present invention is shown, in which the general function and the structure of tensioning device 20' is mostly similar to the tensioning device 20 illustrated in FIG. 3 and the above discussion is equally applicable in the most instances. The only variation is that the piston member 23 now is replaced with a modified second piston member 23' and the annular ring 24 is omitted and replaced with a plunger member 24'. The second piston member 23' comprises a cylindrical body which has a diameter equal to the central bore 224, a central bore 225', a threaded recess 226' engaged with the safety stopper 28, an annular flange 236', an annular extension 237' axially extended outward from the fore end having a plurality of screw holes formed spaced apart around the rim for directly engage the piston member 23' with the grip housing 25 by means of screws 255, an annular flange 238' extended inward from an inner periphery of the extension 237' and a hydraulic fluid chamber 235' within the piston member abutting the flange 238' which is respectively communicated with an external hydraulic source (not shown) by a pair of first and second conduits 234' and 239'. The plunger member 24' comprises a cylinder body 241' having an annular flange 242' extended outward from a periphery thereof and slidably disposed in the chamber 235', a threaded outer periphery 243' engaged with the threaded inner periphery 271 of the grip assembly 27 and a central bore 244' axially extended through the body 241'. In operation, first grip the other end of the tendon 30 which is now terminated in the central bore 244', then supply the hydraulic fluid into the chamber 235' via the conduit 234' so that the plunger member 24' is forced to move toward leftward to actuate the grip assembly 27 and the grip jaws 26 pressing against the camming surface of the grip housing 25. Because of that the grip housing 25 is now engaged with the second piston member 23' and remains stationary, the grip jaws 26 are forced to move inward toward each other to tightly grip the tendon 30 therebetween. The difference between this embodiment and the above embodiment is that the above embodiment releases the hydraulic pressure from the chamber 235 to force the grip housing 25 moving rightward to press the grip jaws 26 which remain stationary and this embodiment contrarily supplies the hydraulic pressure into the chamber 235' via conduit 34' to force the grip jaws 26 moving leftward to press the grip housing 25 which remains stationary. Although, both embodiments provide the same grip result, but this embodiment has an advantage to ensure that the grip jaws 26 will not become loss when the piston member 23' moves rightward. However, to prevent the tendon 30 from becoming bowed, a handle 213 is provided to axially adjust the adaptor 21. This arrangement has also an advantage to make sure a closed engagement between the adaptor 21 and the anchor seat 10 prior to the actuation of the piston member 23'.

Figure 6:
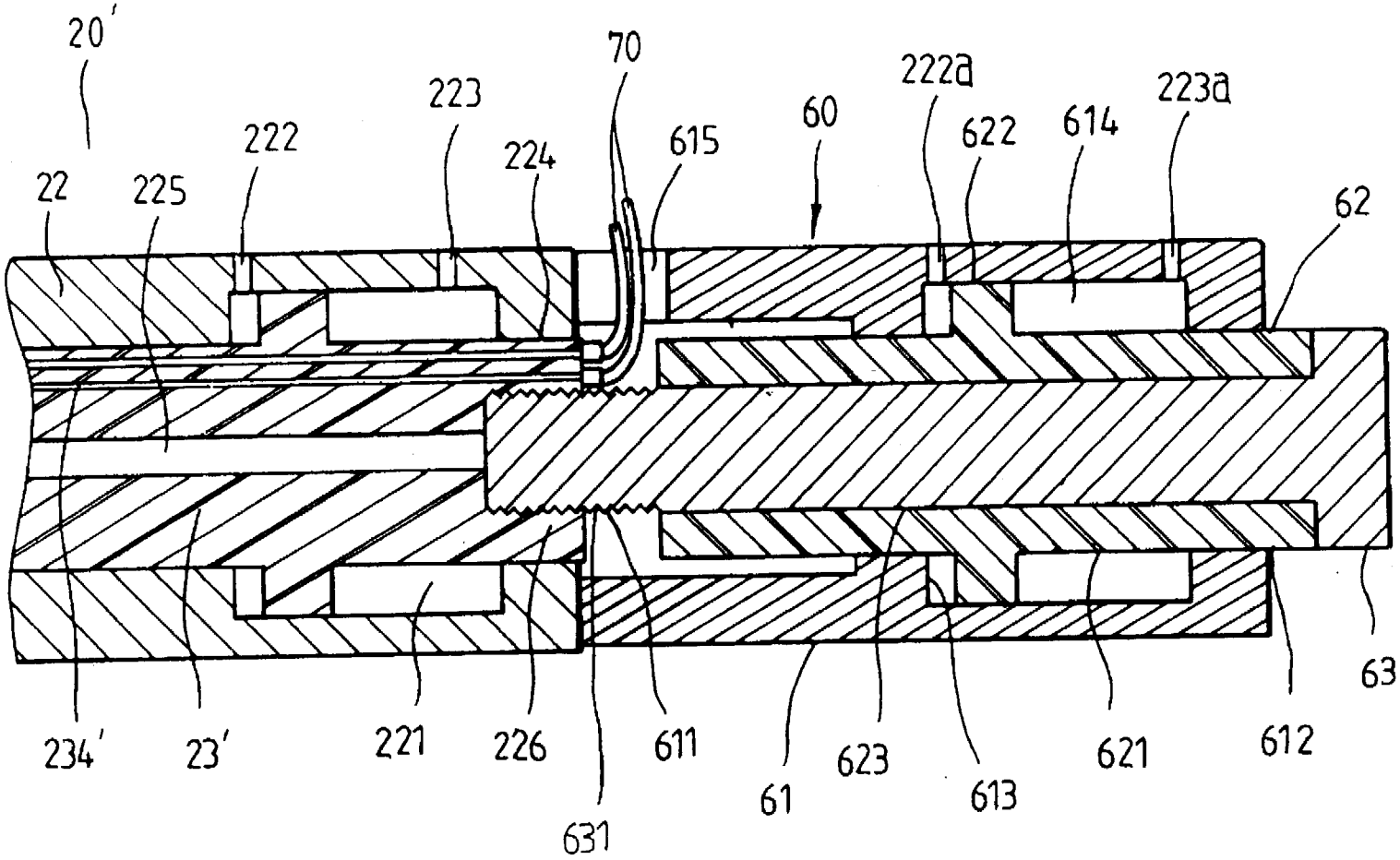
FIG. 6 is a sectional .view to show another alternative embodiment of the present invention.

Referring to FIG. 6, a supplemental tensioning device 60 is shown which is provided to support the tensioning device 20' when additional tensioning force is required and comprises generally a second hollow cylindrical housing 61 and a third piston member 62. The housing 61 has the openings 611 and 612 centrally formed at two ends, an annular flange 613 extended inward from an inner peripheral wall and a hydraulic chamber 614 defined between the flange 613 and the bottom thereof and communicated to an external hydraulic source (not shown) via a pair of conduits **222*a* and 223*a*. The third piston member 62 slidably disposed into the housing 61 and has a hollow cylinder body 621, an annular flange 622 extended outward from an outer periphery thereof and engaged into the chamber 614 and a central bore 623 for axially engaging a shaft 63 therein which is a roughly T-shaped body and has a threaded extension 631 protruded outward from the opening 611 and engaged into the recess 226' of the second piston member 23'. The housing 61 further has a passage 615 provided at a fore end for permitting a pair of hoses 70 from the conduits 234' and 239' to pass over. Because the conduits 222*a* and 223*a* of the housing 61 connect to the same hydraulic source of the conduits 222 and 223 of the housing 22, both the piston member 62 and 23' are simultaneously actuated and moved in concert so as to provide greater tensioning force to the tendon 30** in operation. To this end, more or less tensioning devices can be connected in series in order to enhance its capability and to save the time and labor in the operation.

Based on aforediscussed embodiments, the present invention provides numerous features and advantages outlined as follows:

a) the gripping position of the tendon is displaceable with the transversal movement of the grip jaws and the distal of the tendon remains in the piston member, in addition to a stopper in the end of the piston member that provides a great protection to ambient personnel when the distal of the tendon is accidentally broken, b) the universal engagement of the anchor seat with the adaptor on their spherical surfaces provides an automatic adjustment of a co-linear of tensioning direction that maintain a co-axial line between the tendon and the tensioning direction so as to obviate the shear on the tendon to decline its normal strength, and c) the supplemental tensioning device provides a great flexible in a prestressed concrete tensioning system which facilitates a rearrangement of the appropriate tensioning force to cope with the substantial situation of a prestressed tensioning operation.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A prestressed concrete tensioning system for a tensioning tendon comprising:

an anchor seat embedding in one end of a prestressed concrete beam and comprising a hollow hemisphere body having a plurality of screw holes formed spaced apart around a rim and a tapered extension including a tapered central bore and a corrugated outer periphery axially extending outward from a bottom thereof, a hollow hemisphere cover engaging said hollow hemisphere body by means of screws to define a spherical receiving space therein, said cover having a plurality of screw holes in a rim thereof made in registry with the screw holes of said hollow hemisphere body and a circular recess including an aperture therein centrally formed in a bottom thereof, a pair of identical hemisphere members for configuring a spherical body movably disposing into said spherical receiving space and biasing by a spring means, said hemisphere members each having a semi-conical groove for configuration of a tapered central bore thereinbetween formed along a radial line of a flat portion thereof, and a pair of semi-conical means for configuring a tapered body slidably disposing into said tapered central bore, said semi-conical means each having a semi-cylindrical groove centrally formed along the axis including a plurality of inverse ratchets formed therein for gripping said tendon therebetween;

a prestressed tensioning device comprising:

an adaptor having a hollow cylindrical body, a hemispherical concave formed in a fore end and a threaded inner periphery in a rear end thereof;

a hollow cylindrical housing engaging said adaptor having a central bore through the body, a neck axially extending outward from a fore end including a threaded outer periphery which is made in registry with the threaded inner periphery of said adaptor, a hydraulic fluid chamber in a rear portion communicating an external hydraulic source via a pair of first and second conduits in a peripheral wall of said housing;

a piston member slidably disposing into the central bore of said housing having a cylinder body, an annular flange extending outward from an outer periphery, a stepped extension axially extending outward from a fore end including peripheral thread adjacent a free end thereof, a central bore axially extending through the body, a conduit axially extending along a peripheral wall and through the body thereof and a threaded circular recess centrally formed in a bottom for engaging a cylindrical stopper therein which has a threaded outer periphery and a transverse slot in outward end;

an annular ring slidably disposing on the stepped extension of said piston member having an annular flange extending inward from a medial inner periphery and a plurality of screw holes formed spaced apart around a fore rim thereof;

a grip assembly engaging the stepped extension of said piston member having a hollow cylindrical body of U-shaped section, a central bore aligning with the central bore of said piston member, a threaded inner periphery made in registry with the threaded outer periphery of said stepped extension and a dovetail slot transversely extending across the bottom along a radial line thereof;

a pair of grip jaws slidably engaging said grip assembly each having a wedged outward surface, a flat inward surface, a dovetail tang projecting outward from a bottom made in registry with the dovetail slot of said grip assembly, a central groove axially extending through the flat inward surface and a pair of recesses formed adjacent the central groove for engaging in a pair of spring rods respectively;

a grip housing engaging said annular ring by means of screws, having a plurality of screw holes axially formed through a peripheral wall and made in registry with the screw holes of said annular ring and a cylindrical space abutting a tapered space formed inside the body thereof for receiving said grip jaws and said grip assembly therein;

whereby said prestressed tensioning device in cooperation with said anchor seat provide sufficient tensioning force to complete a prestressed tensioning process for a prestressed concrete beam.

2. A tensioning system according to claim 1 further comprises a second piston member directly engaging said grip housing having a cylindrical body, an annular flange extending outward from an outer periphery and engaging into the hydraulic fluid chamber of said housing therein, a central bore axially extending through the body, a threaded recess in a rear end thereof for engaging within a cylinder stopper which has a threaded outer periphery made in registry with the threaded recess and a transverse slot in an outward end, an annular flange extending inward from an inner wall of forward end to define an opening and a hydraulic fluid chamber thereinbetween for slidably disposing a plunger member therein and an annular extension extending outward from the forward end including a plurality of screw holes formed spaced apart around the rim thereof which are made in registry with the screw holes of said grip housing.

3. A tensioning system according to claim 2 wherein said plunger member engages with said grip assembly and comprises a cylindrical body, a central bore axially extending through the body and aligning with the central bores of said grip assembly and said piston member, a threaded outer periphery adjacent a leftward end made in registry with the threaded inner periphery of said grip assembly and an annular flange extending outward from a medial outer periphery and engaging in said hydraulic fluid chamber.

4. A tensioning system according to claim 1 further comprises a supplemental tensioning device connecting said second piston member and has a hollow cylindrical housing including openings in two ends, a second annular flange extending inward from a medial inner periphery to define a hydraulic fluid chamber therein which is communicating an external hydraulic source via a pair of conduits, and a passage formed at a forward end for passing over a pair of hoses from said second piston, a third piston member having a hollow cylindrical body slidably disposing into the central bore of said housing, an annular flange extending outward from a medial outer periphery and engaging into said hydraulic fluid chamber and a shaft of a roughly T-shaped section inserting through the central bore of said third piston member having a threaded forward end extending out of the second housing and engaging the threaded recess of said second piston member therein.

* * * * *

UNITED STATES PATENT AND TRADEMARK OFFICE

CERTIFICATE OF CORRECTION

PATENT NO. : 5,718,090
DATED : February 17,1998
INVENTOR(S) : Wei-Hwang Lin

It is certified that error appears in the above-identified patent and that said Letters Patent is hereby corrected as shown below:

On the title page, item [75] Inventor should read --Wei-Hwang Lin, Dept. of Military Engr., Chinese Military Academy, 830 R.O.C. Feng Shan, Taiwan --.

Signed and Sealed this

Eighteenth Day of August, 1998

Bruce Lehman

*Attest:*

BRUCE LEHMAN

*Attesting Officer*

*Commissioner of Patents and Trademarks*